US009789347B2

(12) United States Patent
Lalaoua

(10) Patent No.: US 9,789,347 B2
(45) Date of Patent: Oct. 17, 2017

(54) FOLDING EXERCISE CHAIR FOR RESISTANCE TRAINING

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/493,125

(22) Filed: Apr. 20, 2017

(65) Prior Publication Data

US 2017/0216649 A1 Aug. 3, 2017

Related U.S. Application Data

(63) Continuation-in-part of application No. PCT/IB2016/054191, filed on Jul. 13, 2016, which is a continuation-in-part of application No. 15/204,863, filed on Jul. 7, 2016, now Pat. No. 9,744,401, application No. 15/493,125, which is a continuation-in-part of application No. PCT/IB2016/005542, filed on Sep. 12, 2016, which is a continuation-in-part of application No. 15/258,047, filed on Sep. 7, 2016, application No. 15/493,125, which is a continuation-in-part of application No. PCT/IB2016/053903, filed on Jun. 29, 2013, application No. 15/258,047, which is a continuation-in-part of application No. 15/187,564, (Continued)

(51) Int. Cl.

| | |
|---|---|
| ***A63B 23/02*** | (2006.01) |
| ***A63B 21/04*** | (2006.01) |
| ***A63B 21/00*** | (2006.01) |
| ***A63B 21/16*** | (2006.01) |
| ***A63B 23/04*** | (2006.01) |
| ***A63B 21/055*** | (2006.01) |

(52) U.S. Cl.

CPC ..... *A63B 21/0407* (2013.01); *A63B 21/0552* (2013.01); *A63B 21/154* (2013.01); *A63B 21/1609* (2015.10); *A63B 21/4027* (2015.10); *A63B 21/4034* (2015.10); *A63B 21/4035* (2015.10); *A63B 21/4039* (2015.10); *A63B 23/04* (2013.01); *A63B 2210/50* (2013.01); *A63B 2225/093* (2013.01)

(58) Field of Classification Search

None

See application file for complete search history.

(56) References Cited

U.S. PATENT DOCUMENTS 4,838,547 A * 6/1989 Sterling ..... A63B 23/00 482/104

4,921,247 A * 5/1990 Sterling ..... A63B 17/00 482/130

(Continued)

*Primary Examiner* — Stephen R Crow

(57) ABSTRACT

A folding exercise chair for resistance training has a collapsible chair frame, a pair of resistance mechanisms, and a padded cross-brace. The collapsible chair frame has a seat and a height-adjustable backing. The height adjustable backing is an assembly that enables a user to modify the height of the collapsible chair frame's backrest. The padded cross-brace is connected offset from the seat and across the collapsible chair frame to support the user's back and add comfort while the user is exercising. Each of the pair of resistance mechanisms is a device used to facilitate resistance training exercises. To that end, each of the pair of resistance mechanisms is positioned on either side of the collapsible chair frame.

19 Claims, 13 Drawing Sheets

Related U.S. Application Data filed on Jun. 20, 2016, application No. 15/493,125, which is a continuation-in-part of application No. PCT/IB2016/054213, filed on Jul. 14, 2016, and a continuation-in-part of application No. 29/577,628, filed on Sep. 14, 2016, and a continuation-in-part of application No. 15/265,768, filed on Sep. 14, 2016, application No. 15/493,125, which is a continuation-in-part of application No. 15/265,791, filed on Sep. 14, 2016, and a continuation-in-part of application No. PCT/IB2016/055760, filed on Sep. 26, 2016, which is a continuation-in-part of application No. 15/265,791, filed on Sep. 14, 2016, application No. 15/493,125, which is a continuation-in-part of application No. PCT/IB2016/055761, filed on Sep. 26, 2016, and a continuation-in-part of application No. 15/492,929, filed on Apr. 20, 2017.

(60) Provisional application No. 62/231,629, filed on Jul. 13, 2015, provisional application No. 62/283,840, filed on Sep. 14, 2015, provisional application No. 62/391,111, filed on Apr. 20, 2016.

(56) References Cited

U.S. PATENT DOCUMENTS 5,080,353 A * 1/1992 Tench ..... A63B 21/154 482/130
5,090,694 A * 2/1992 Pauls ..... A63B 21/015 482/118
5,176,601 A * 1/1993 Reynolds ..... A63B 23/03525 482/121
5,324,243 A * 6/1994 Wilkinson ..... A63B 21/055 482/121
5,362,296 A * 11/1994 Wang ..... A63B 21/0552 482/121
5,387,171 A * 2/1995 Casey ..... A63B 21/0552 482/130
5,542,898 A * 8/1996 Wilkinson ..... A63B 21/0552 482/120
5,674,167 A * 10/1997 Piaget ..... A63B 21/0552 482/130
5,833,582 A * 11/1998 Chen ..... A63B 21/00072 482/115
5,899,836 A * 5/1999 Chen ..... A63B 21/0552 482/130
6,110,081 A * 8/2000 Barrett ..... A63B 21/055 482/121
6,117,056 A * 9/2000 Cataldi, Jr. ..... A63B 21/0552 482/121
6,159,133 A * 12/2000 Shugg ..... A63B 21/023 482/121
6,220,995 B1 * 4/2001 Chen ..... A63B 21/02 297/175
6,537,185 B1 * 3/2003 Hur ..... A63B 23/1209 482/121
6,752,745 B1 * 6/2004 Davis ..... A63B 21/00 482/129
6,872,170 B2 * 3/2005 Kuo ..... A63B 21/028 482/123
6,981,932 B1 * 1/2006 Huang ..... A63B 21/00072 482/121
7,331,911 B2 * 2/2008 Webber ..... A63B 21/4047 482/100
7,361,127 B2 * 4/2008 Tremayne ..... A63B 21/055 482/121
7,377,889 B2 * 5/2008 Cusak ..... A61H 7/001 297/452.32
8,672,817 B2 3/2014 Bowser et al.
8,876,676 B2 11/2014 Lalaoua
2004/0152572 A1 * 8/2004 Reitz ..... A63B 23/035 482/140
2017/0014674 A1 * 1/2017 Lalaoua ..... A63B 22/0605
2017/0014677 A1 * 1/2017 Lalaoua ..... A63B 21/023

* cited by examiner

FOLDING EXERCISE CHAIR FOR RESISTANCE TRAINING

The current application claims a priority to the U.S. Provisional Patent application Ser. No. 62/391,111 filed on Apr. 20, 2016.

FIELD OF THE INVENTION

The present invention relates generally to a resistance training device. More specifically, the present invention relates to an exercise chair that uses a plurality of resistance training mechanisms to perform a wide variety of resistance training exercises.

BACKGROUND OF THE INVENTION

Traditional workout devices are dedicated to single tasks which workout isolated muscle additionally, these devices use high impact systems that can damage joints and ligaments. While working out with resistance to gravity is an effective means of building muscle, traditional exercise systems limit the range om motion that the user is able to use while performing strength and resistance training.

The present invention addresses these shortcomings by providing a total body workout machine that perform over 50 exercises in both the sitting and standing positions. The present invention can be uses at home, in health clubs, as well as both indoors and outdoors. The present invention is a fitness device for people who want to get a stronger core and have a better-looking waistline. Additionally, the present invention facilitates losing weight in a short period of time. The present invention can be uses by all age groups while offering comfort and secure balance. The present invention only request a small space to operate the device and easy for storage.

The present invention is a completely new sitting full body workout exercise apparatus. The unique design offers great convenience and a simplified way to engaging a variety of muscle groups in a way that builds muscle strength and burns calories. The present invention is a safe and comfortable apparatus that uses low impact resistance tension bands or cables to enable exercises while in sitting and standing positions. The present invention a convenient solution for building lean muscle, a stronger body, and muscle definition. The present invention is designed to minimize the time spent exercising, while maximizing the positive results of the exercise. The present invention helps anyone at any fitness level to achieve great fitness goals results while eliminating complicated and confusing products.

DETAIL DESCRIPTIONS OF THE INVENTION

Figure 1:
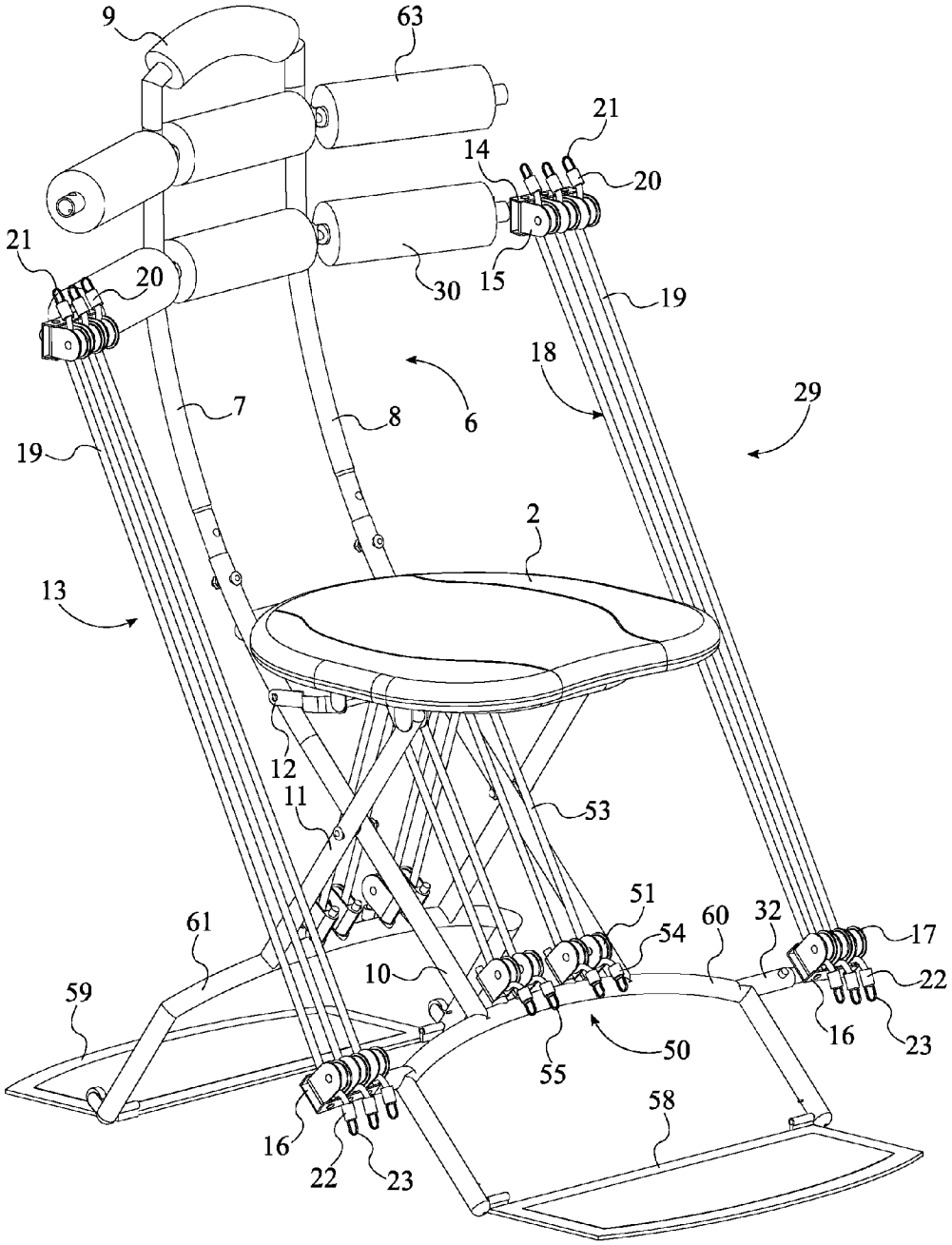
FIG. 1 is a perspective view of the present invention.

All illustrations of the drawings are for the purpose of describing selected versions of the present invention and are not intended to limit the scope of the present invention.

As can be seen in FIG. 1 through FIG. 13, the present invention, the folding exercise chair for resistance training, is an apparatus that employs pullies to enable a user to perform a wide variety of exercises with resistance bands and retractable cord reels. The present invention is designed to be used with as a strength training system that enables the user to perform both sitting and standing exercises. To accomplish this, the present invention makes use of pulleys that are mounted onto the exercise chair at positions that enable the user to exercise isolated muscle groups. For example, the user can sit on the present invention and work their quadricep muscles by attaching resistance bands to the ankles and straightening their legs. Conversely, the user is able to stand and work their hamstring muscles by attaching the resistance bands to the ankles and raising their leg at the knee. The present invention is intended to be collapsed so that the user is able to easily store the present invention while not in use.

As can be seen in FIG. 1 through FIG. 4, to achieve the above describes functionality, the present invention comprises a collapsible chair frame 1, a left resistance mechanism 13, a right resistance mechanism 29, and a first padded cross brace 30. The collapsible chair frame 1 functions as the structural foundation of the present invention onto which the remaining components are mounted. The collapsible chair frame 1 comprises a seat 2 and a height-adjustable backing 6. The height-adjustable backing 6 is the back support of the collapsible chair frame 1 that the user is able to lengthen, shorten, and/or reposition as desired. The first padded cross brace 30 is a padded beam that is used to increase the ergonomic design of the present invention. To that end, the first padded cross brace 30 is oriented perpendicular to the height-adjustable backing 6 so that the first padded cross brace 30 is able to support the back of the user. The first padded cross brace 30 is preferable a beam with foam rollers that are positioned along the length of the beam to provide a comfortable rest for the user's back. The first padded cross brace 30 and the seat 2 are positioned opposite to each other along the height-adjustable backing 6. Consequently, the seat 2 is able to support the user's bottom and the first padded cross brace 30 is able to support the user's back. The left resistance mechanism 13 and the right resistance mechanism 29 are assemblies that use resistance bands, retracting cord reels, and pulleys to enable the user to perform a variety of resistance training exercises. To that end, the left resistance mechanism 13 is laterally mounted to the collapsible chair frame 1. As a result, the left resistance mechanism 13 facilitates exercising the muscle groups on the left side of the body. Similarly, the right resistance mechanism 29 being laterally mounted to the collapsible chair frame 1, opposite to the left resistance mechanism 13. Thus positioned, the right resistance mechanism 29 facilitates exercising the muscle groups on the right side of the body, opposite to the left resistance mechanism 13.

As can be seen in FIG. 1, to expand on the description of the collapsible chair frame 1, the collapsible chair frame 1 further comprises a first frame member 10, a second frame member 11, and a linkage 12. The first frame member 10 and the second frame member 11 are rigid assemblies that form the front and rear legs of the collapsible chair frame 1. To that end, the first frame member 10 is centrally and pivotally connected the second frame member 11. Accordingly, the first frame member 10 and the second frame member 11 form a scissoring mechanism that forms an X-shape when the present invention is deployed and collapse onto each other when the present invention is collapsed. The seat 2 is terminally and pivotally connected to the second frame member 11 so that the seat 2 is able to pivot around the end of the second frame member 11 as the present invention is transitioned between a collapsed configuration and a deployed configuration. To facilitate this pivoting motion, the seat 2 is terminally and pivotally connected to the linkage 12, offset from the second frame member 11. Additionally, the first frame member 10 is terminally and pivotally connected to the linkage 12, opposite to the seat 2. Consequently, the linkage 12 enables the seat 2 to be supported by the first frame member 10 when the present invention is in the deployed configuration. Additionally, the linkage 12 ensures that the first frame member 10, the second frame member 11, and the seat 2 move in concert as the present invention is transitioned between the collapsed configuration and the deployed configuration.

Figure 4:
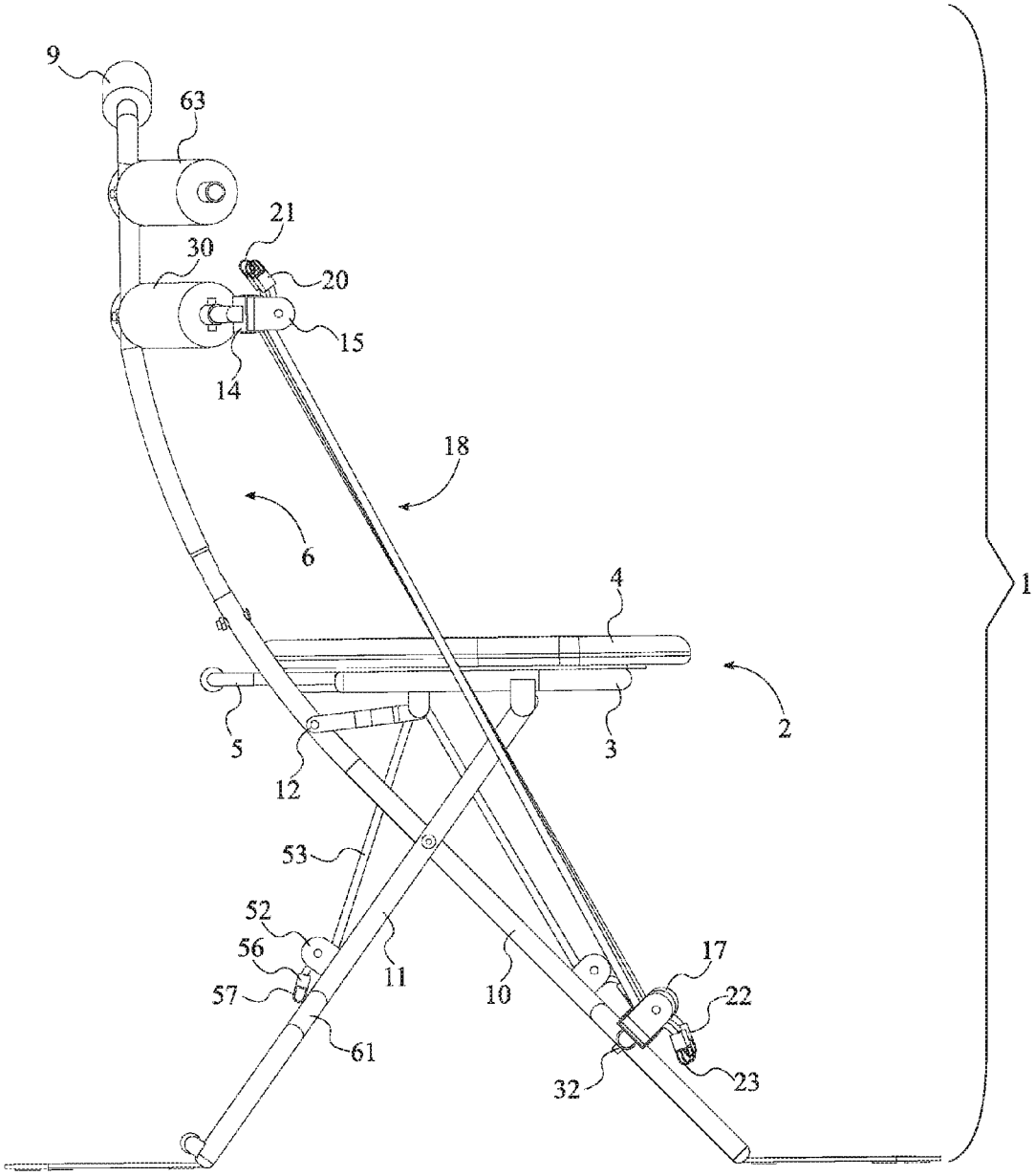
FIG. 4 is a left-side view of the present invention.
Figure 5:
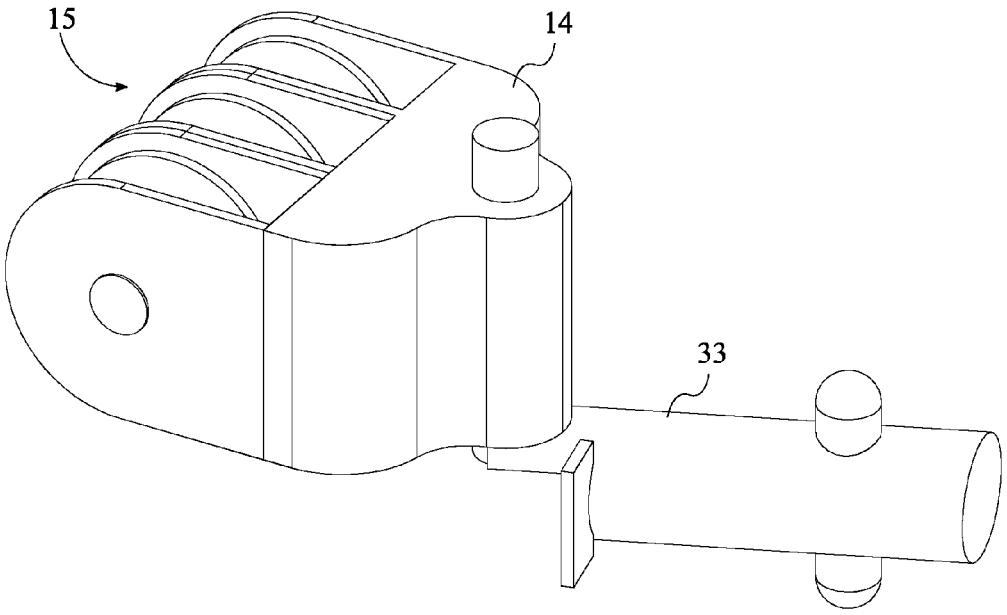
FIG. 5 is a perspective view of the top bracket and the plurality of top pullies used in the first alternative embodiment of the present invention.
Figure 6:
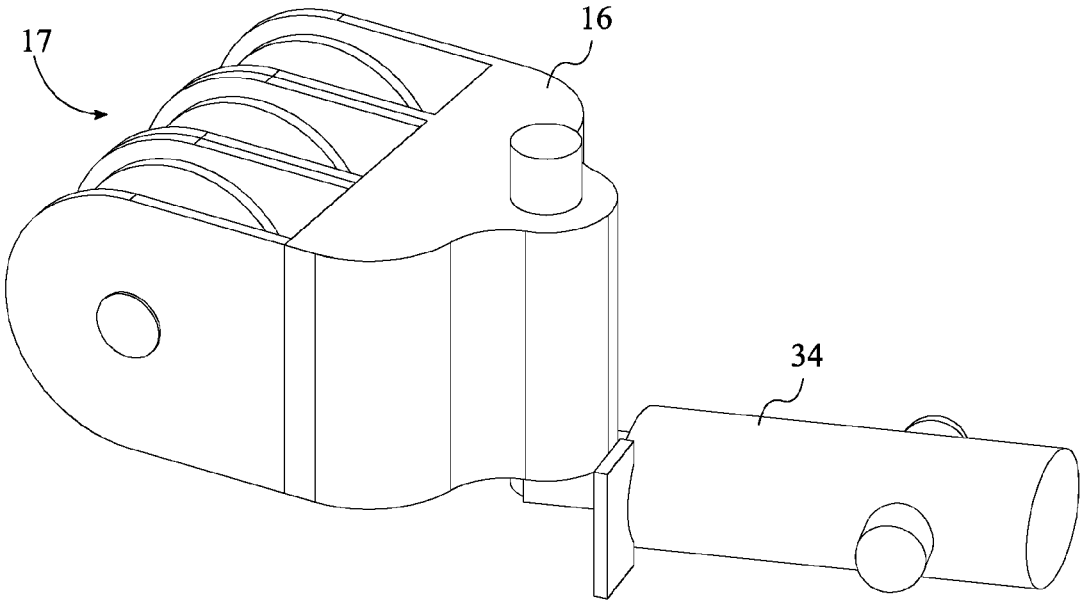
FIG. 6 is a perspective view of the bottom bracket and plurality of bottom pullies used in the first alternative embodiment of the present invention.

As can be seen in FIG. 1 and FIG. 4, the present invention further comprises a handle 5. The handle 5 is laterally connected to the seat 2. As a result, the handle 5 enables the user to transition the present invention from between the collapsed configuration and the deployed configuration by repositioning the seat 2. The handle 5 is positioned in between the left resistance mechanism 13 and the right resistance mechanism 29. Thus positioned, the handle 5 can be easily grasped while not interfering with the user's ability to perform resistance training exercises. While the handle 5 enables the user to reposition the seat 2, the seat 2 is designed to function as a swiveling device that grants the user freedom to twist from side-to-side while seated. To accomplish this, the seat 2 comprises a base 3 and a cushion 4. The base 3 is a fixed support frame that is connected to the second frame member 11 and the linkage 12. The cushion 4 is a padded platform on which the user is seated. The cushion 4 is swivelably mounted onto the base 3. Accordingly, the cushion 4 is able to swivel while the user performs exercises. The cushion 4 is preferably mounted onto the base 3 by a "Lazy Susan" bearing mechanism.

Figure 2:
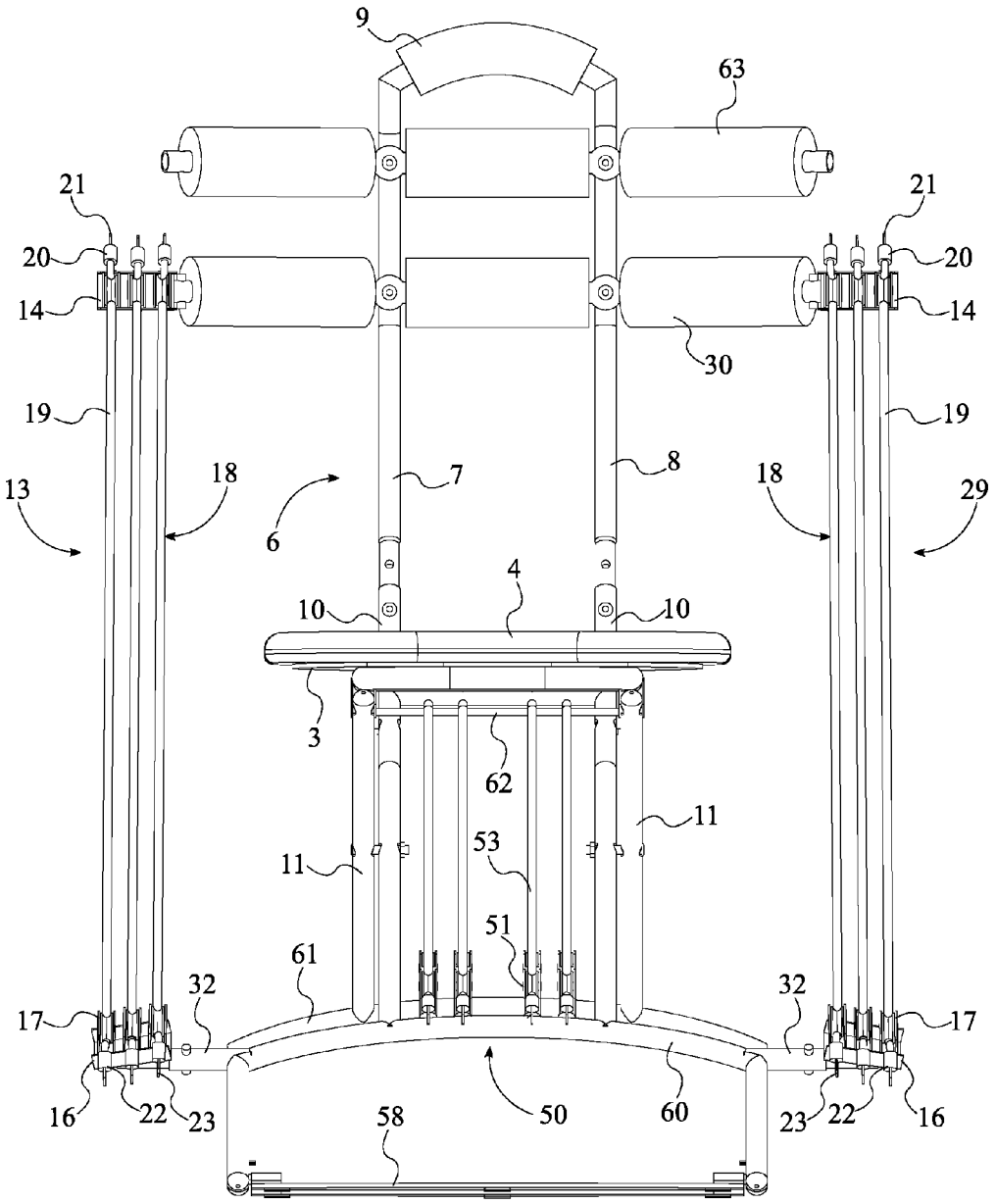
FIG. 2 is a front view of the present invention.
Figure 3:
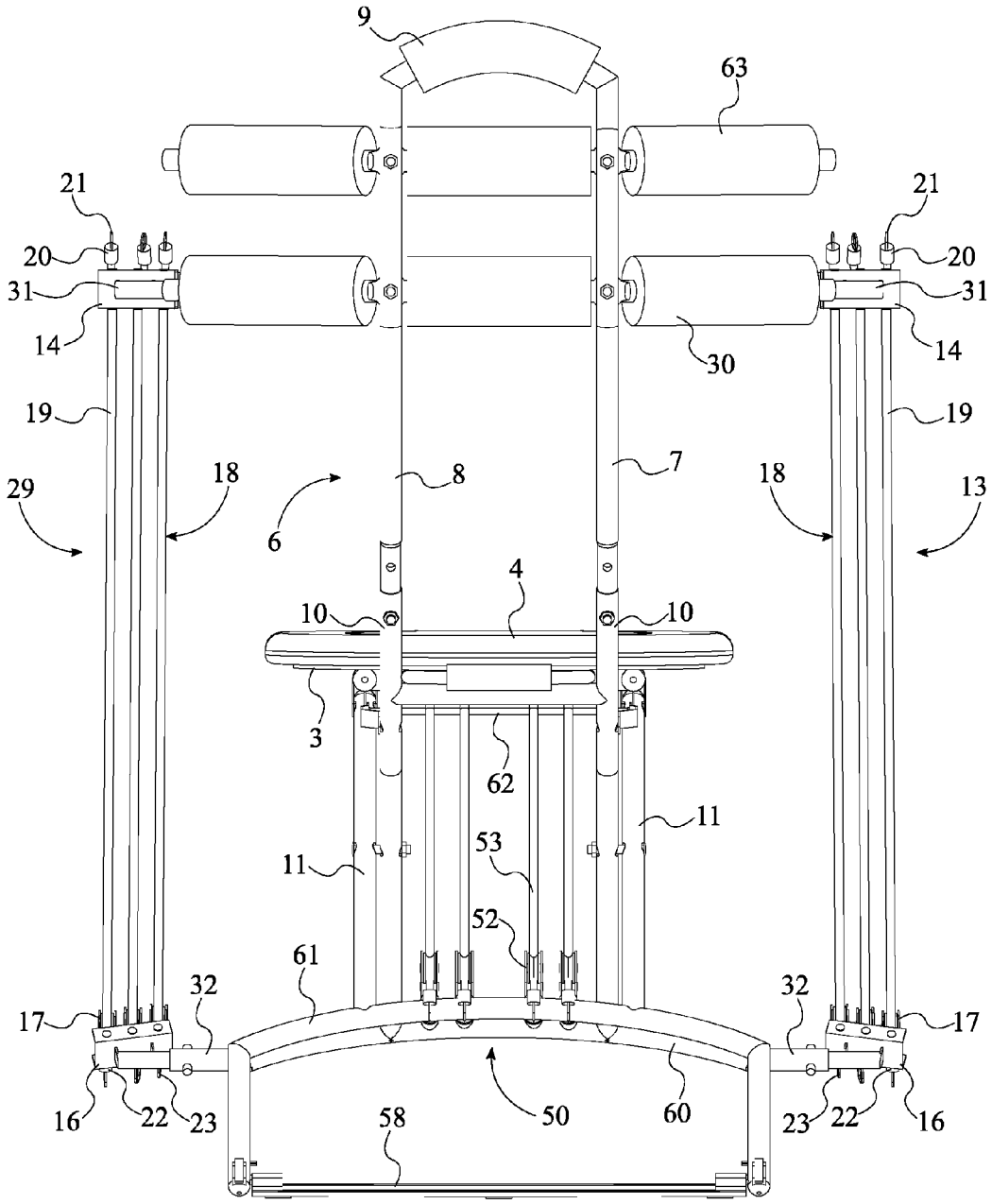
FIG. 3 is a rear view of the present invention.

As can be seen in FIG. 2 and FIG. 3, the user of the present invention is able to work a variety of muscle groups using the left resistance mechanism 13 and the right resistance mechanism 29. To accomplish this, the left resistance mechanism 13 and the right resistance mechanism 29 each comprise a top bracket 14, a plurality of top pulleys 15, a bottom bracket 16, a plurality of bottom pulleys 17, and a plurality of resistance bands 18. The top bracket 14 and the bottom bracket 16 are bracketing support devices that are used to maintain the plurality of top pulleys 15 and the plurality of bottom pulleys 17 in positions that facilitate performing resistance training exercises with the plurality of resistance bands 18. That is, both the top bracket 14 and the bottom bracket 16 are rigid C-shaped brackets that fit around the plurality of top pullies 15 and the plurality of bottom pullies 17. The top bracket 14 is detachably mounted adjacent to the first padded cross brace 30 so that the top bracket 14 maintains the plurality of top pulleys 15 and the plurality of resistance bands 18 in positions that facilitate performing exercises. The plurality of top pulleys 15 is serially distributed along the top bracket 14. Consequently, the top bracket 14 and the plurality of top pulleys 15 form a cassette of pulleys that engage the plurality of resistance bands 18. Expanding on this idea, each of the plurality of top pulleys 15 is pivotally connected to the top bracket 14. As a result, each of the plurality of top pulleys 15 is able to pivot independently under forces exerted by the user.

As can be seen in FIG. 3 and FIG. 4, likewise, the bottom bracket 16 and the plurality of bottom pulleys 17 mirrors the arrangement of the top bracket 14 and the plurality of top pulleys 15. As such, the bottom bracket 16 is detachably mounted adjacent to the collapsible chair frame 1, opposite to the height-adjustable backing 6. Thus positioned, the bottom bracket 16 maintains the plurality of bottom pulleys 17 and the plurality of resistance bands 18 in positions that facilitate performing exercises. The plurality of bottom pulleys 17 is serially distributed along the bottom bracket 16. Accordingly, the bottom bracket 16 and the plurality of bottom pulleys 17 form a cassette of pulleys that engage the plurality of resistance bands 18. Expanding on this idea, each of the plurality of bottom pulleys 17 is pivotally connected to the bottom bracket 16. Consequently, each of the plurality of bottom pulleys 17 is able to pivot independently under forces exerted by the user.

As can be seen in FIG. 1 through FIG. 4, to fully describe the components of the left resistance mechanism 13 and the right resistance mechanism 29, it is required to specify that each of the plurality of resistance bands 18 is tensionably engaged between a corresponding top pulley from the plurality of top pulleys 15 and a corresponding bottom pulley from the plurality of bottom pulleys 17. As a result, each resistance band can be pulled over a corresponding top pulley and a corresponding bottom pulley as the user performs various exercises. Each of the plurality of resistance bands 18 comprises a band body 19, a top stop 20, a top eyelet 21, a bottom stop 22, and a bottom eyelet 23. The band body 19 is a cord of elastic material that can be stretched during resistance training exercises. The top stop 20 is a rigid block of material that is terminally connected to the band body 19. Thus positioned, the top stop 20 prevents the band body 19 from being pulled through the corresponding top pulley. Conversely, the bottom stop 22 is a rigid block of material that is terminally connected to the band body 19, opposite to the top stop 20. Accordingly, bottom stop 22 prevents the band body 19 from being pulled through the corresponding bottom pulley. The corresponding top pulley and the corresponding bottom pulley are tensionably engaged to the band body 19 in between the top stop 20 and the bottom stop 22. Consequently, the band body 19 is able to move over the corresponding top pulley and the corresponding bottom pulley when the user performs resistance training exercises. The top eyelet 21 is fixed to the top stop 20 so that the user is able to attach exercise equipment such as handles, straps, and the like to the top stop 20. Similarly, the bottom eyelet 23 is fixed to the bottom stop 22 so that the user is able to attach exercise equipment such as handles, straps, and the like, to the bottom stop 22.

As can be seen in FIG. 1, FIG. 3 and FIG. 4, to attach the top bracket 14 and the bottom bracket 16 to the collapsible chair frame 1, the left resistance mechanism 13 and the right resistance mechanism 29 each further comprises a top tubular connection mechanism 31 and a bottom tubular connection mechanism 32. The top tubular connection mechanism 31 and the bottom tubular connection mechanism 32 are detachable fasteners that are used to mount the top bracket 14 and the bottom bracket 16 onto the collapsible chair frame 1. To that end, the top bracket 14 is terminally connected to the top tubular connection mechanism 31. Additionally, the top tubular connection mechanism 31 is telescopically and terminally engaged into the first padded cross brace 30, opposite to the top bracket 14. As a result, the top tubular connection mechanism 31 extends between the top bracket 14 and the first padded cross brace 30 and acts as the detachable fastener that attaches the top bracket 14 to the first padded cross brace 30. Mirroring the top tubular connection mechanism 31, the bottom bracket 16 is terminally connected to the bottom tubular connection mechanism 32. Additionally, the bottom tubular connection mechanism 32 is mounted onto the collapsible chair frame 1, opposite to the bottom bracket 16. As a result, the bottom tubular connection mechanism 32 extends between the bottom bracket 16 and the collapsible chair frame 1 and acts as the detachable fastener that attaches the bottom bracket 16 to the collapsible chair frame 1.

As can be seen in FIG. 1, in a first alternative embodiment of the present invention, the cassette of pulleys formed by the top bracket 14 and the bottom bracket 16 is designed with pulleys that are unable to pivot independently. To accomplish this the left resistance mechanism 13 and the right resistance mechanism 29 each comprise a top bracket 14, a plurality of top pulleys 15, a bottom bracket 16, a plurality of bottom pulleys 17, a plurality of resistance bands 18. The top bracket 14 is detachably mounted adjacent to the first padded cross brace 30 so that the top bracket 14 maintains the plurality of top pulleys 15 and the plurality of resistance bands 18 in positions that facilitate performing exercises. The plurality of top pulleys 15 is serially distributed along the top bracket 14. Consequently, the top bracket 14 and the plurality of top pulleys 15 form a cassette of pulleys that engage the plurality of resistance bands 18. Expanding on this idea, each of the plurality of top pulleys 15 is fixed to the top bracket 14. As a result, each of the plurality of top pulleys 15 is prevented from moving unless the top bracket 14 is moved.

As can be seen in FIG. 1, also for the first alternative embodiment of the present invention, the bottom bracket 16 and the plurality of bottom pulleys 17 mirrors the arrangement of the top bracket 14 and the plurality of top pulleys 15. As such, the bottom bracket 16 is detachably mounted adjacent to the collapsible chair frame 1, opposite to the height-adjustable backing 6. Thus positioned, the bottom bracket 16 maintains the plurality of bottom pulleys 17 and the plurality of resistance bands 18 in positions that facilitate performing exercises. The plurality of bottom pulleys 17 is serially distributed along the bottom bracket 16. Accordingly, the bottom bracket 16 and the plurality of bottom pulleys 17 form a cassette of pulleys that engage the plurality of resistance bands 18. Expanding on this idea, each of the plurality of bottom pulleys 17 is fixed to the bottom bracket 16. Consequently, each of the plurality of bottom pulleys 17 is prevented from moving unless the bottom bracket 16 is moved. Each of the plurality of resistance bands 18 is tensionably engaged between a corresponding top pulley from the plurality of top pulleys 15 and a corresponding bottom pulley from the plurality of bottom pulleys 17. As a result, each resistance band can be pulled over a corresponding top pulley and a corresponding bottom pulley as the user performs various exercises.

As can be seen in FIG. 1, FIG. 4, FIG. 5, and FIG. 6, in this first alternative embodiment, the top bracket 14 and the bottom bracket 16 are blocks of pulleys that prevent the individual pulleys from pivoting but are pivotably mounted onto to the collapsible chair frame 1 instead. To accomplish this, the left resistance mechanism 13 and the right resistance mechanism 29 each further comprises a top pivoting connection mechanism 33 and a bottom pivoting connection mechanism 34. The top pivoting connection mechanism 33 and the bottom pivoting connection mechanism 34 are preferably L-shaped protrusions that are used to pivotably mount the top bracket 14 and the bottom bracket 16 onto the collapsible chair frame 1. To that end, the top bracket 14 is pivotably connected to the top pivoting connection mechanism 33. Additionally, the top pivoting connection mechanism 33 is connected adjacent to the first padded cross brace 30. As a result, a first leg of the L-shaped top pivoting connection mechanism 33 is pivotably connected to the top bracket 14, and a second leg of the L-shaped top pivoting connection mechanism 33 is fixedly connected to the first padded cross brace 30. Mirroring the top pivoting connection mechanism 33, the bottom bracket 16 is pivotably connected to the bottom pivoting connection mechanism 34. Additionally, the bottom pivoting connection mechanism 34 is connected adjacent to the collapsible chair frame 1. Thus connected, a first leg of the L-shaped bottom pivoting connection mechanism 34 is pivotably connected to the bottom bracket 16, and a second leg of the L-shaped bottom pivoting connection mechanism 34 is fixedly connected to the collapsible chair frame 1, opposite to the top bracket 14.

Figure 7:
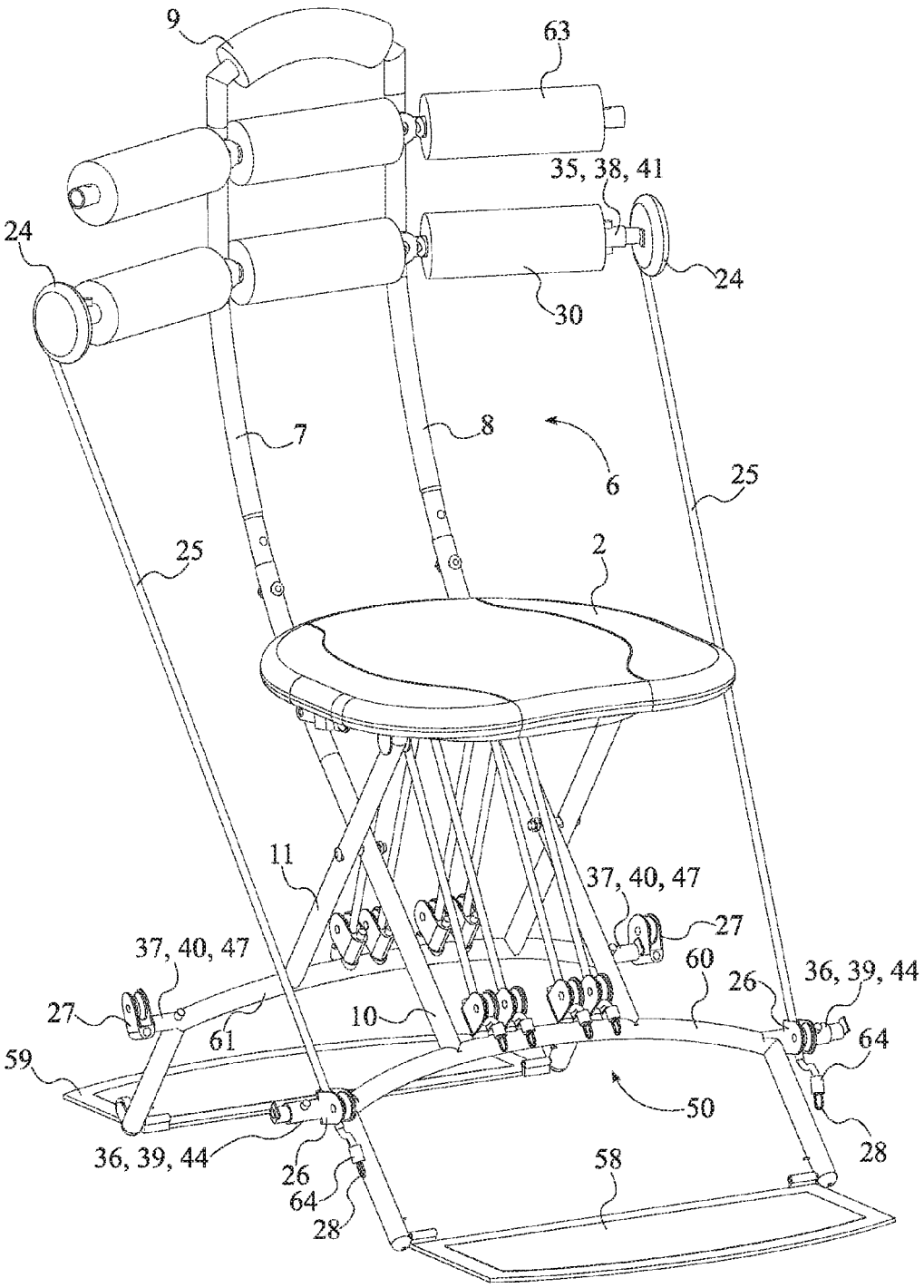
FIG. 7 is a perspective view of the second alternative embodiment of the present invention where the resistance mechanism uses the torsionally retracting reel.
Figure 8:
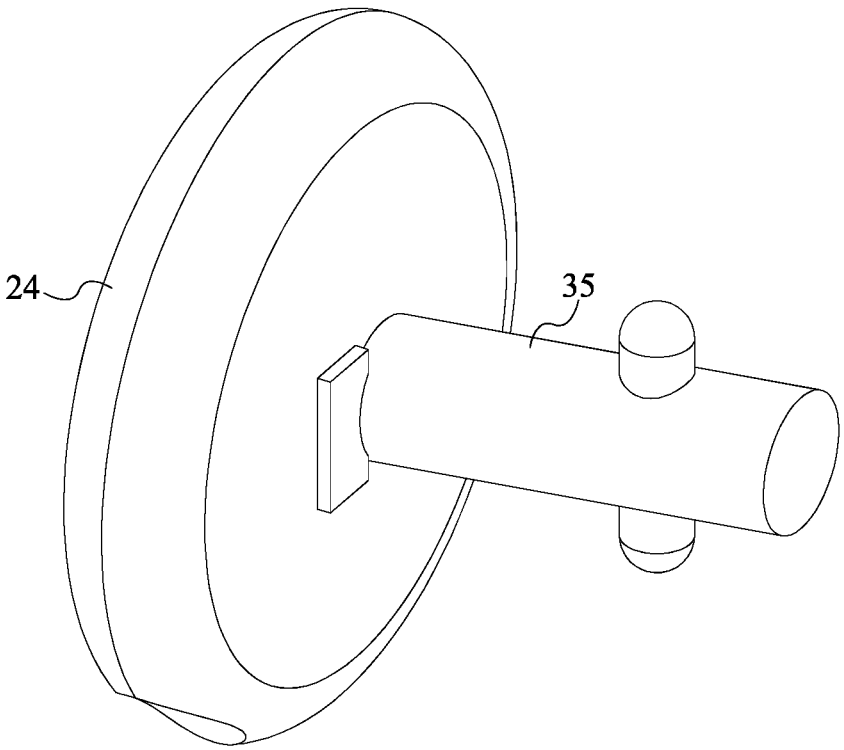
FIG. 8 is a perspective view of the torsionally retracting cord reel and the first tubular reel connection mechanism used in the second alternative embodiment of the present invention.
Figure 9:
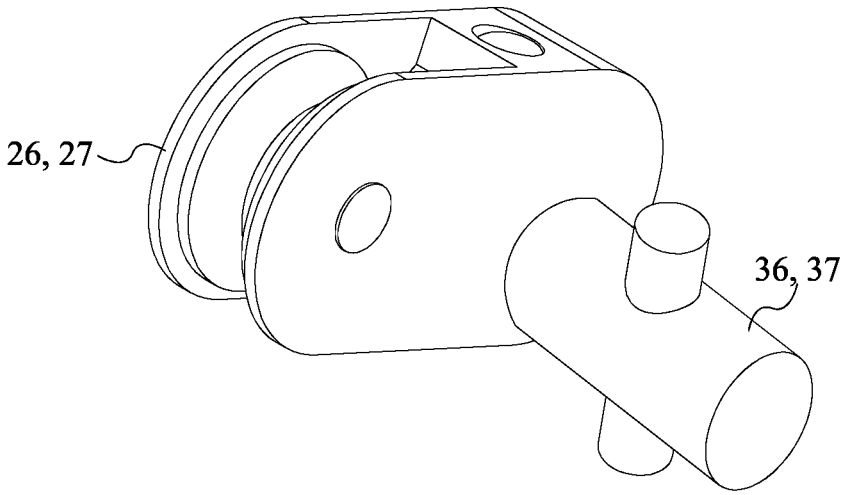
FIG. 9 is a perspective view of the front pulley, the rear pulley, the second tubular reel connection mechanism, and the third tubular reel connection mechanism used in the second alternative embodiment of the present invention.
Figure 10:
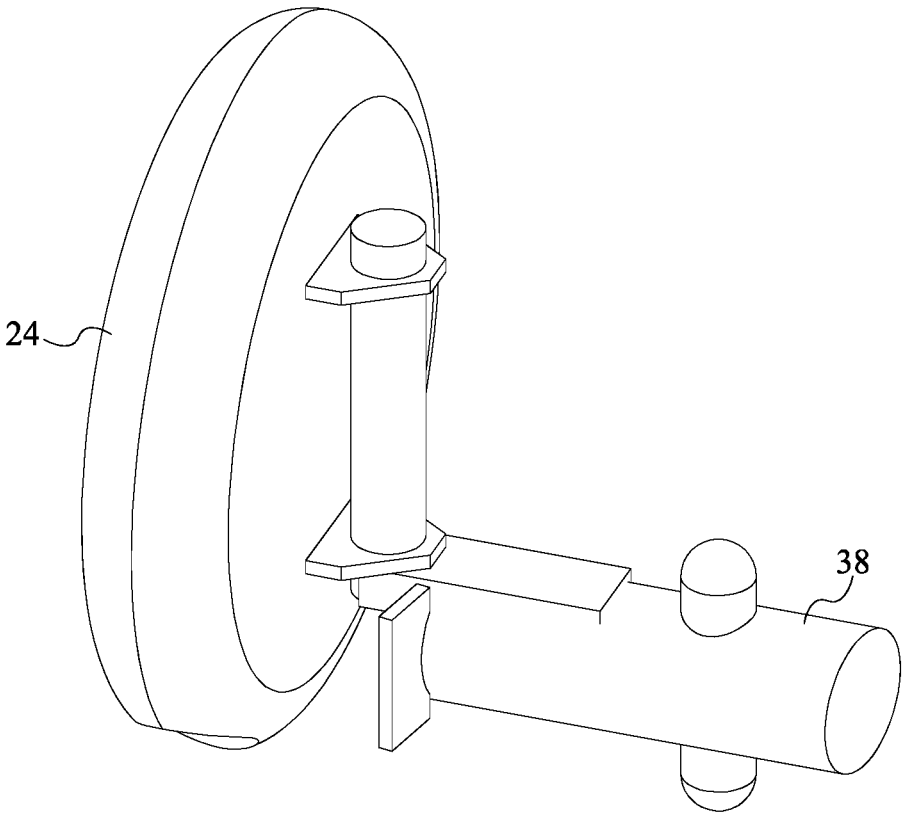
FIG. 10 is a perspective view of the torsionally retracting cord reel and the first pivoting reel connection mechanism used in the third alternative embodiment of the present invention.
Figure 11:
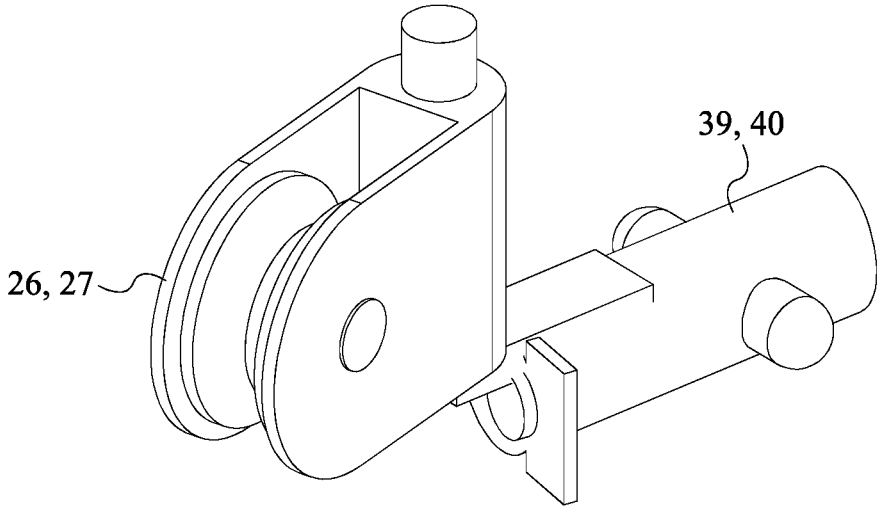
FIG. 11 is a perspective view of the front pulley, the rear pulley, the second pivoting reel connection mechanism, and the third pivoting reel connection mechanism used in the third alternative embodiment of the present invention.
Figure 12:
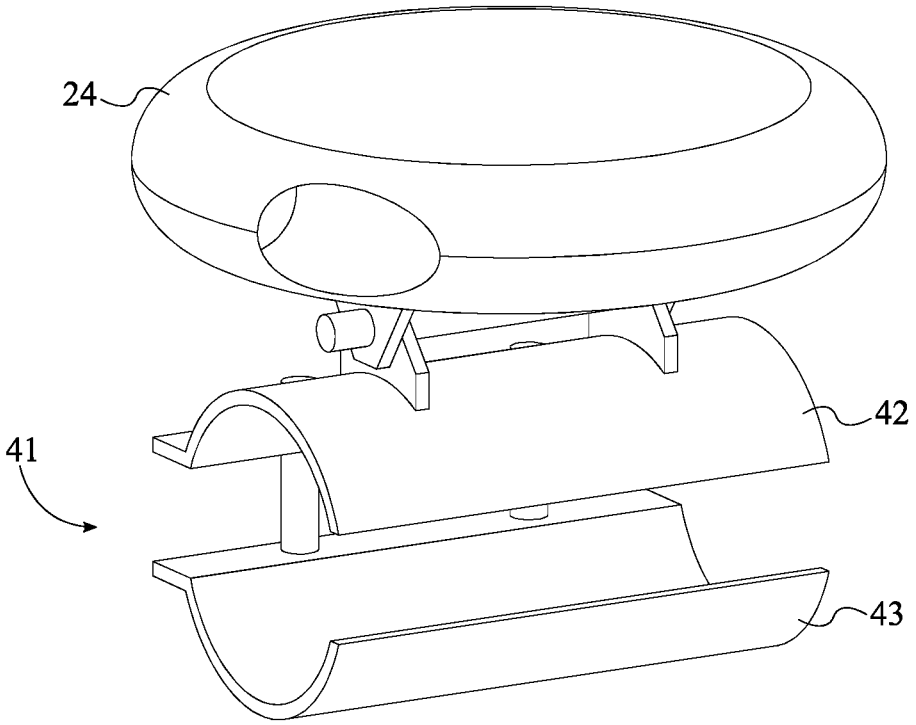
FIG. 12 is a perspective view of the torsionally retracting cord reel and the first clamping reel connection mechanism used in the fourth alternative embodiment of the present invention.
Figure 13:
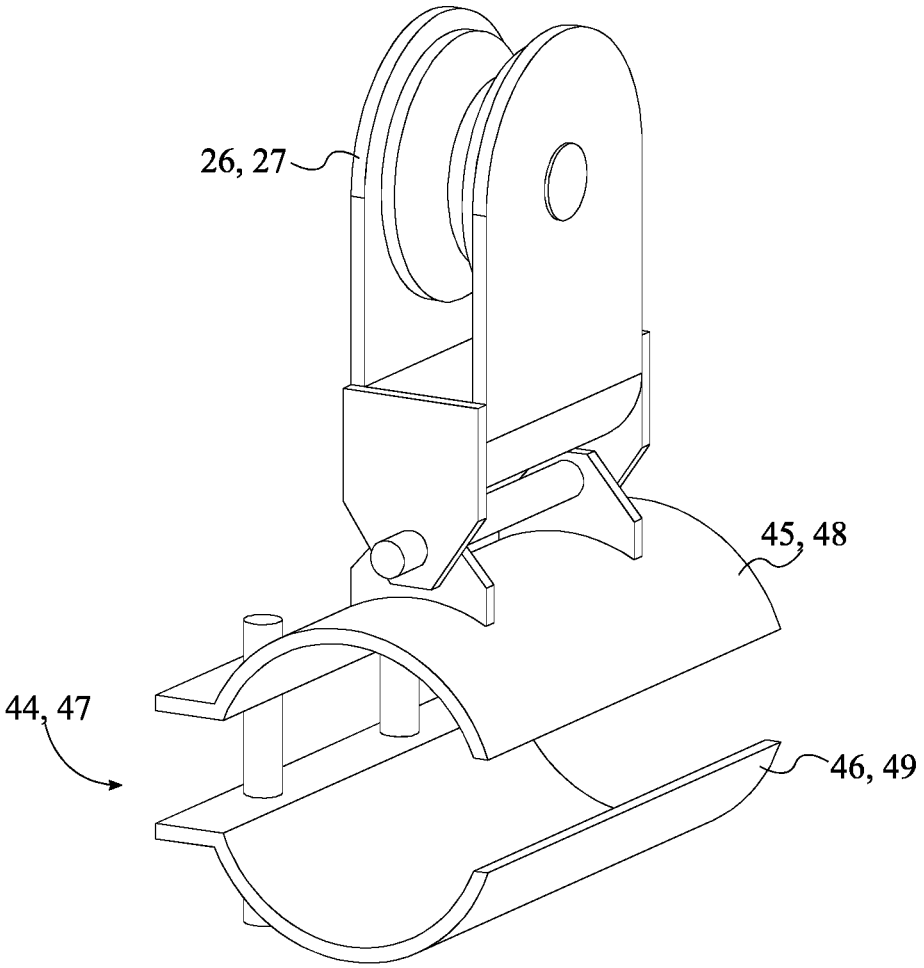
FIG. 13 is a perspective view of the front pulley, the rear pulley, the second clamping reel connection mechanism, and the third clamping reel connection mechanism used in the fourth alternative embodiment of the present invention.

As can be seen in FIG. 4 and FIG. 7, in a second alternative embodiment of the present invention, the left resistance mechanism 13 and the right resistance mechanism 29 are designed to employ retracting reel devices that resist the forces applied by the user while performing resistance training exercises. To accomplish this the left resistance mechanism 13 and the right resistance mechanism 29 each comprise a torsionally retracting reel 24, a cable 25, a front reel pulley 26, a rear reel pulley 27, a reel stop 64, and a reel eyelet 28. The torsionally retracting reel 24 is a reel that automatically retracts any length of cable 25 that is dispensed. That is, the torsionally retracting reel 24 exerts a force that resists the cable 25 being unspooled while the user is performing resistance training. In the second alternative embodiment, the torsionally retracting reel 24 is used to replace the plurality of resistance bands 18 and the plurality of pulleys. To accomplish this the torsionally retracting reel 24 is detachably mounted onto the first padded cross brace 30 so that the user is able to easily grasp and manipulate the torsionally retracting reel 24. The front reel pulley 26 is detachably mounted adjacent to the collapsible chair frame 1, opposite to the height-adjustable backing 6. Accordingly, the user is able to perform specific resistance training exercises by looping the cable 25 through the front reel pulley 26. The rear reel pulley 27 is detachably mounted adjacent to the collapsible chair frame 1, across from the front reel pulley 26. Consequently, the user is able to perform a different group of resistance training exercises by electing to loop the cable 25 through the rear reel pulley 27. The cable 25 is wound about the torsionally retracting reel 24 so that the torsionally retracting reel 24 is able to apply a force to the cable 25 that resists the user's efforts to unspool the cable 25 out of the torsionally retracting reel 24. The reel stop 64 is terminally connected to the cable 25, opposite to the torsionally retracting reel 24. As a result, the user is able to easily grab onto one end of the cable 25. Additionally, the reel eyelet 28 is fixed to the reel stop 64 so that the user is able to attach handles and exercise equipment to the cable 25.

As can be seen in FIG. 4, FIG. 7, FIG. 8, and FIG. 9, in the second alternative embodiment, the torsionally retracting reel 24, the front reel pulley 26, and the rear reel pulley 27 can be interchangeably mounted onto various positions of the collapsible chair frame 1. To that end, the left resistance mechanism 13 and the right resistance mechanism 29 each further comprises a first tubular reel connection mechanism 35, a second tubular reel connection mechanism 36, and a third tubular reel connection mechanism 37 which are identically constructed, and thus interchangeable. The torsionally retracting reel 24 is terminally connected to the first tubular reel connection mechanism 35. Additionally, the first tubular reel connection mechanism 35 is telescopically and terminally engaged into the first padded cross brace 30, opposite to the torsionally retracting reel 24. As a result, the first tubular reel connection mechanism 35 extends between the torsionally retracting reel 24 and the first padded cross brace 30 and acts as the detachable fastener that attaches the torsionally retracting reel 24 to the first padded cross brace 30. Minoring the first tubular reel connection mechanism 35, the front reel pulley 26 is terminally connected to the second tubular reel connection mechanism 36. Additionally, the second tubular reel connection mechanism 36 is telescopically and terminally engaged into the collapsible chair frame 1, opposite to the front reel pulley 26. As a result, the second tubular reel connection mechanism 36 extends between the front reel pulley 26 and the collapsible chair frame 1, and acts as the detachable fastener that attaches the front reel pulley 26 to the collapsible chair frame 1. Finally, the rear reel pulley 27 is terminally connected to the third tubular reel connection mechanism 37. Additionally, the third tubular reel connection mechanism 37 is telescopically and terminally engaged into the collapsible chair frame 1, opposite to the rear reel pulley 27. As a result, the third tubular reel connection mechanism 37 extends between the rear reel pulley 27 and the collapsible chair frame 1 and acts as the detachable fastener that attaches the rear reel pulley 27 to the collapsible chair frame 1.

As can be seen in FIG. 4, FIG. 7, FIG. 10, and FIG. 11, in a third alternative embodiment of the present invention, the torsionally retracting reel 24, the front reel pulley 26, and the rear reel pulley 27 can be interchangeably mounted onto various positions of the collapsible chair frame 1. To that end, the left resistance mechanism 13 and the right resistance mechanism 29 each further comprises a first pivoting reel connection mechanism 38, a second pivoting reel connection mechanism 39, and a third pivoting reel connection mechanism 40 which are identically constructed, and thus interchangeable. The first pivoting reel connection mechanism 38, the second pivoting reel connection mechanism 39, and the third pivoting reel connection mechanism 40 are preferably L-shaped protrusions that are used to pivotably mount the torsionally retracting reel 24, the front reel pulley 26, and the rear reel pulley 27 onto the collapsible chair frame 1. The torsionally retracting reel 24 is pivotably mounted onto the first pivoting reel connection mechanism 38. Additionally, the first pivoting reel connection mechanism 38 is connected adjacent to the first padded cross brace 30, opposite to the torsionally retracting reel 24. As a result, a first leg of the L-shaped first pivoting reel connection mechanism 38 is pivotably connected to the torsionally retracting reel 24, and a second leg of the L-shaped first pivoting reel connection mechanism 38 is fixedly connected to the first padded cross brace 30. Mirroring the first pivoting reel connection mechanism 38, the front reel pulley 26 is pivotably mounted onto to the second pivoting reel connection mechanism 39. Additionally, the second pivoting reel connection mechanism 39 is connected adjacent to the collapsible chair frame 1. As a result, a first leg of the L-shaped second pivoting reel connection mechanism 39 is pivotably connected to the front reel pulley 26, and a second leg of the L-shaped second pivoting reel connection mechanism 39 is fixedly connected to the collapsible chair frame 1. Finally, the rear reel pulley 27 is pivotably mounted onto to the third pivoting reel connection mechanism 40. Additionally, the third pivoting reel connection mechanism 40 is connected adjacent to the collapsible chair frame 1. As a result, a first leg of the L-shaped third pivoting reel connection mechanism 40 is pivotably connected to the rear reel pulley 27, and a second leg of the L-shaped third pivoting reel connection mechanism 40 is fixedly connected to the collapsible chair frame 1.

As can be seen in FIG. 4, FIG. 7, FIG. 12, and FIG. 13, in a fourth alternative embodiment of the present invention, the torsionally retracting reel 24, the front reel pulley 26, and the rear reel pulley 27 can be interchangeably mounted onto various positions of the collapsible chair frame 1. To that end, the left resistance mechanism 13 and the right resistance mechanism 29 each further comprises a first clamping reel connection mechanism 41, a second clamping reel connection mechanism 44, and a third clamping reel connection mechanism 45 which are identically constructed, and thus interchangeable. The torsionally retracting reel 24 is adjacently connected to a fixed jaw 42 of the first clamping reel connection mechanism 41. Additionally, the first padded cross brace 30 is positioned in between the fixed jaw 42 of the first clamping reel connection mechanism 41 and a movable jaw 43 of the first clamping reel connection mechanism 41. As a result, the first clamping reel connection mechanism 41 acts as the detachable fastener that clamps the torsionally retracting reel 24 onto the first padded cross brace 30. Mirroring the first clamping reel connection mechanism 41, the front reel pulley 26 is adjacently connected to a fixed jaw 45 of the second clamping reel connection mechanism 44. Additionally, a portion of the collapsible chair frame 1 is positioned in between the fixed jaw 45 of the second clamping reel connection mechanism 44 and a movable jaw 46 of the second clamping reel connection mechanism 44. As a result, the second clamping reel connection mechanism 44 acts as the detachable fastener that clamps the front reel pulley 26 onto the collapsible chair frame 1. Finally, the rear reel pulley 27 is adjacently connected to a fixed jaw 48 of the third clamping reel connection mechanism 45. Additionally, another potion of the collapsible chair frame 1 is positioned in between the fixed jaw 48 of the third clamping reel connection mechanism 45 and a movable jaw 49 of the third clamping reel connection mechanism 45. As a result, the third clamping reel connection mechanism 45 acts as the detachable fastener that clamps the rear reel pulley 27 onto the collapsible chair frame 1.

As can be seen in FIG. 1 and FIG. 4, in the present invention, the user is able to stabilize the collapsible chair frame 1 while performing resistance training exercises by standing on a front foot rest 58. That is, the present invention further comprises a front foot rest 58 that is a rigid plate which extends from the front legs of the collapsible chair frame 1. The front footrest 58 is hingedly connected to the collapsible chair frame 1. Thus connected, the user is able to store the front foot rest against the collapsible chair frame 1 while not in use. The height-adjustable backing 6 and the front footrest 58 are positioned opposite to each other along the collapsible chair frame 1. Furthermore, the height-adjustable backing 6 and the front footrest 58 are positioned opposite to each other about the seat 2. Accordingly, the front footrest 58 is positioned toward the bottom of the front legs of the collapsible chair frame 1. This positioning enables the user to step on the front footrest 58 and have the front footrest 58 be supported by the surface on which the present invention is resting.

As can be seen in FIG. 1 and FIG. 4, similar to the front footrest 58, the user is able to stabilize the collapsible chair frame 1 while performing resistance training exercises by standing on a rear foot rest 59. That is, the present invention further comprises a rear foot rest that is a rigid plate which extends from the rear legs of the collapsible chair frame 1. The rear footrest 59 is hingedly connected to the collapsible chair frame 1. Thus connected, the user is able to store the rear foot rest against the collapsible chair frame 1 while not in use. The height-adjustable backing 6 and the rear footrest 59 are positioned opposite to each other along the collapsible chair frame 1. Furthermore, the height-adjustable backing 6 and the rear footrest 59 are positioned adjacent to each other about the seat 2. Accordingly, the rear footrest 59 is positioned toward the bottom of the rear legs of the collapsible chair frame 1. This positioning enables the user to step on the rear footrest 59 and have the rear footrest 59 be supported by the surface on which the present invention is resting.

As can be seen in FIG. 2 and FIG. 3, the present invention is designed to accommodate a variety of resistance training exercises. To that end, the present invention further comprises a plurality of auxiliary resistance mechanisms 50, a front support bar 60, a rear support bar 61, and a crossbar 62. Each of the plurality of auxiliary resistance mechanisms 50 is a resistance band based assembly that is used to facilitate resistance training exercises for the user's legs. As such, each of the plurality of auxiliary resistance mechanisms 50 comprises a front pulley 51, a rear pulley 52, and a resistance band 53. The front support bar 60 and the rear support bar 61 are connected across the collapsible chair frame 1, opposite to the height-adjustable backing 6. Furthermore, the front support bar 60 and the rear support bar 61 are positioned opposite to each other about the seat 2. Consequently, the front support bar 60 is positioned beneath the seat 2 and extends between the front legs of the collapsible chair frame 1. Similarly, the rear support bar 61 is positioned beneath the seat 2 and extends between the rear legs of the collapsible chair frame 1. The crossbar 62 is mounted offset from the seat 2. As a result, the crossbar 62 is positioned beneath the seat 2 and acts as a fulcrum for the plurality of auxiliary resistance mechanisms 50. To position the components of the plurality of auxiliary resistance mechanisms 50 such that the crossbar 62 is utilized as a fulcrum, the front pulley 51 is pivotably connected to the front support bar 60 and the rear pulley 52 is pivotably connected to the rear support bar 61. Additionally, the resistance band 53 is tensionably engaged to the front pulley 51, the crossbar 62, and the rear pulley 52. Thus positioned, the front pulley 51, the rear pulley 52, and the resistance band 53 are able to function as a resistance training system that utilizes the mechanical advantage gained by tensioning the resistance ban over the crossbar 62.

As can be seen in FIG. 1 and FIG. 4, in the present invention, each of the plurality of auxiliary resistance mechanisms 50 further comprises a front stop 54, a front eyelet 55, a rear stop 56, and a rear eyelet 57. The front stop 54 is a rigid block of material that is terminally connected to the resistance band 53. Thus positioned, the front stop 54 prevents the resistance band 53 from being pulled through the front pulley 51. Conversely, the rear stop 56 is a rigid block of material that is terminally connected to the resistance band 53, opposite to the front stop 54. Accordingly, the rear stop 56 prevents the resistance band 53 from being pulled through the rear pulley 52. The front pulley 51 and the rear pulley 52 are tensionably engaged to the resistance band 53 in between the front stop 54 and the rear stop 56. Consequently, the resistance band 53 moves over the front pulley 51 and the rear pulley 52 when the user performs resistance training exercises. The front eyelet 55 is fixed to the front stop 54 so that the user is able to attach exercise equipment such as handles, straps, and the like to the front stop 54 Similarly, the rear eyelet 57 is fixed to the rear stop 56 so that the user is able to attach exercise equipment such as handles, straps, and the like to the rear stop 56.

As can be seen in FIG. 2 and FIG. 3, to increase the comfort of the height-adjustable backing 6, the present invention further comprises a second padded cross-brace 63. The second padded cross-brace 63 is oriented perpendicular to the height-adjustable backing 6. Additionally, the second padded cross-brace 63 is positioned offset from the first padded cross brace 30 along the height-adjustable backing 6. Furthermore, the second padded cross-brace 63 is positioned opposite to the seat 2 along the height-adjustable backing 6. Thus positioned, the second padded cross-brace 63 is oriented parallel to the first padded cross brace 30 and further stabilizes the user while performing resistance training exercises.

As can be seen in FIG. 1 and FIG. 4, n the present invention, the height-adjustable backing 6 comprises a first telescopic tube 7, a second telescopic tube 8, and a connective handlebar 9. The first telescopic tube 7 and the second telescopic tube 8 are rigid support tubes that form the structural frame of the height-adjustable backing 6. To that end, the first telescopic tube 7 is oriented parallel to the second telescopic tube 8 so that the back of the collapsible chair frame 1 is a generally flat surface. The connective handlebar 9 is terminally connected to the first telescopic tube 7. Furthermore, the connective handlebar 9 is terminally connected to the second telescopic tube 8. Thus positioned, the connective handlebar 9 enables the user to easily grasp and relocate the present invention. The first telescopic tube 7 is slidably and pivotably engaged to the collapsible chair frame 1, opposite to the connective handlebar 9. Additionally, the second telescopic tube 8 is slidably and pivotably engaged to the collapsible chair frame 1, opposite to the connective handlebar 9. As a result, the user is able to adjust the height of the height-adjustable backing 6 by sliding the first telescopic tube 7 and the first telescopic tube 8 into the collapsible chair frame 1.

Although the invention has been explained in relation to its preferred embodiment, it is to be understood that many other possible modifications and variations can be made without departing from the spirit and scope of the invention as hereinafter claimed.

What is claimed is:

1. A folding exercise chair for resistance training comprises:

a collapsible chair frame;

a left resistance mechanism;

a right resistance mechanism;

a first padded cross brace;

the collapsible chair frame comprises a seat and a height-adjustable backing;

the first padded cross brace being oriented perpendicular to the height-adjustable backing;

the first padded cross brace and the seat being positioned opposite to each other along the height-adjustable backing;

the left resistance mechanism being laterally mounted to the collapsible chair frame; and the right resistance mechanism being laterally mounted to the collapsible chair frame, opposite to the left resistance mechanism.

2. The folding exercise chair for resistance training as claimed in claim 1 comprises:

the collapsible chair frame further comprises a first frame member, a second frame member, and a linkage;

the first frame member being centrally and pivotally connected the second frame member;

the seat being terminally and pivotally connected to the second frame member;

the seat being terminally and pivotally connected to the linkage, offset from the second frame member;

the first frame member being terminally and pivotally connected to the linkage, opposite to the seat; and the height-adjustable backing being terminally connected to the first frame member, adjacent to the linkage.

3. The folding exercise chair for resistance training as claimed in claim 2 comprises:

a handle;

the handle being laterally connected to the seat; and the handle being positioned in between the left resistance mechanism and the right resistance mechanism.

4. The folding exercise chair for resistance training as claimed in claim 2 comprises:

the seat comprises a base and a cushion; and the cushion being swivelably mounted onto the base.

5. The folding exercise chair for resistance training as claimed in claim 1 comprises:

the left resistance mechanism and the right resistance mechanism each comprise a top bracket, a plurality of top pulleys, a bottom bracket, a plurality of bottom pulleys, and a plurality of resistance bands;

the top bracket being detachably mounted adjacent to the first padded cross brace;

the plurality of top pulleys being serially distributed along the top bracket;

each of the plurality of top pulleys being pivotally connected to the top bracket;

the bottom bracket being detachably mounted adjacent to the collapsible chair frame, opposite to the height-adjustable backing;

the plurality of bottom pulleys being serially distributed along the bottom bracket;

each of the plurality of bottom pulleys being pivotally connected to the bottom bracket; and each of the plurality of resistance bands being tensionably engaged between a corresponding top pulley from the plurality of top pulleys and a corresponding bottom pulley from the plurality of bottom pulleys.

6. The folding exercise chair for resistance training as claimed in claim 5 comprises:

each of the plurality of resistance bands comprises a band body, a top stop, a top eyelet, a bottom stop, and a bottom eyelet;

the top stop being terminally connected to the band body;

the bottom stop being terminally connected to the band body, opposite to the top stop;

the corresponding top pulley and the corresponding bottom pulley being tensionably engaged to the band body in between the top stop and the bottom stop;

the top eyelet being fixed to the top stop; and the bottom eyelet being fixed to the bottom stop.

7. The folding exercise chair for resistance training as claimed in claim 5 comprises:

the left resistance mechanism and the right resistance mechanism each further comprises a top tubular connection mechanism and a bottom tubular connection mechanism;

the top bracket being terminally connected to the top tubular connection mechanism;

the top tubular connection mechanism being telescopically and terminally engaged into the first padded cross brace, opposite to the top bracket;

the bottom bracket being terminally connected to the bottom tubular connection mechanism; and the bottom tubular connection mechanism being telescopically and terminally engaged into the collapsible chair frame, opposite to the bottom bracket.

8. The folding exercise chair for resistance training as claimed in claim 1 comprises:

the left resistance mechanism and the right resistance mechanism each comprise a top bracket, a plurality of top pulleys, a bottom bracket, a plurality of bottom pulleys, a plurality of resistance bands;

the top bracket being detachably mounted adjacent to the first padded cross brace;

the plurality of top pulleys being serially distributed along the top bracket;

each of the plurality of top pulleys being fixed to the top bracket;

the bottom bracket being detachably mounted adjacent to the collapsible chair frame, opposite to the height-adjustable backing;

the plurality of bottom pulleys being serially distributed along the bottom bracket; and each of the plurality of bottom pulleys being fixed to the bottom bracket;

each of the plurality of resistance bands being tensionably engaged between a corresponding top pulley from the plurality of top pulleys and a corresponding bottom pulley from the plurality of bottom pulleys.

9. The folding exercise chair for resistance training as claimed in claim 8 comprises:

the left resistance mechanism and the right resistance mechanism each further comprises a top pivoting connection mechanism and a bottom pivoting connection mechanism;

the top bracket being pivotably connected to the top pivoting connection mechanism;

the top pivoting connection mechanism being connected adjacent to the first padded cross brace;

the bottom bracket being pivotably connected to the bottom pivoting connection mechanism; and the bottom pivoting connection mechanism being connected adjacent to the collapsible chair frame, opposite to the top bracket.

10. The folding exercise chair for resistance training as claimed in claim 1 comprises:

the left resistance mechanism and the right resistance mechanism each comprise a torsionally retracting reel, a cable, a front reel pulley, a rear reel pulley, a reel stop, and a reel eyelet;

the torsionally retracting reel being detachably mounted onto the first padded cross brace;

the front reel pulley being detachably mounted adjacent to the collapsible chair frame, opposite to the height-adjustable backing;

the rear reel pulley being detachably mounted adjacent to the collapsible chair frame, across from the front reel pulley;

the cable being wound about the torsionally retracting reel;

the reel stop being terminally connected to the cable, opposite to the torsionally retracting reel; and the reel eyelet being fixed to the reel stop.

11. The folding exercise chair for resistance training as claimed in claim 10 comprises:

a first tubular reel connection mechanism;

a second tubular reel connection mechanism;

a third tubular reel connection mechanism;

the torsionally retracting reel being terminally connected to the first tubular reel connection mechanism;

the first tubular reel connection mechanism being telescopically and terminally engaged into the first padded cross brace, opposite to the torsionally retracting reel;

the front reel pulley being terminally connected to the second tubular reel connection mechanism;

the second tubular reel connection mechanism being telescopically and terminally engaged into the collapsible chair frame, opposite to the front reel pulley;

the rear reel pulley being terminally connected to the third tubular reel connection mechanism; and the third tubular reel connection mechanism being telescopically and terminally engaged into the collapsible chair frame, opposite to the rear reel pulley.

12. The folding exercise chair for resistance training as claimed in claim 10 comprises:

a first pivoting reel connection mechanism;

a second pivoting reel connection mechanism;

a third pivoting reel connection mechanism;

the torsionally retracting reel being pivotably connected to the first pivoting reel connection mechanism;

the first pivoting reel connection mechanism being connected adjacent to the first padded cross brace;

the front reel pulley being pivotably connected to the second pivoting reel connection mechanism;

the second pivoting reel connection mechanism being connected adjacent to the collapsible chair frame;

the rear reel pulley being pivotably connected to the third pivoting reel connection mechanism; and the third pivoting reel connection mechanism being connected adjacent to the collapsible chair frame.

13. The folding exercise chair for resistance training as claimed in claim 10 comprises:

a first clamping reel connection mechanism;

a second clamping reel connection mechanism;

a third clamping reel connection mechanism;

the torsionally retracting reel being adjacently connected to a fixed jaw of the first clamping reel connection mechanism;

the first padded cross brace being positioned in between the fixed jaw of the first clamping reel connection mechanism and a movable jaw of the first clamping reel connection mechanism;

the front reel pulley being adjacently connected to a fixed jaw of the second clamping reel connection mechanism;

a portion of the collapsible chair frame being positioned in between the fixed jaw of the second clamping reel connection mechanism and a movable jaw of the second clamping reel connection mechanism;

the rear reel pulley being adjacently connected to a fixed jaw of the third clamping reel connection mechanism; and another portion of the collapsible chair frame being positioned in between the fixed jaw of the third clamping reel connection mechanism and a movable jaw of the third clamping reel connection mechanism.

14. The folding exercise chair for resistance training as claimed in claim 1 comprises:

a front footrest;

the front footrest being hingedly connected to the collapsible chair frame;

the height-adjustable backing and the front footrest being positioned opposite to each other along the collapsible chair frame; and the height-adjustable backing and the front footrest being positioned opposite to each other about the seat.

15. The folding exercise chair for resistance training as claimed in claim 1 comprises:

a rear footrest;

the rear footrest being hingedly connected to the collapsible chair frame;

the height-adjustable backing and the rear footrest being positioned opposite to each other along the collapsible chair frame; and the height-adjustable backing and the rear footrest being positioned adjacent to each other about the seat.

16. The folding exercise chair for resistance training as claimed in claim 1 comprises:

a plurality of auxiliary resistance mechanisms;

a front support bar;

a rear support bar;

a crossbar;

each of the plurality of auxiliary resistance mechanisms comprises a front pulley, a rear pulley, and a resistance band;

the front support bar and the rear support bar being connected across the collapsible chair frame, opposite to the height-adjustable backing;

the front support bar and the rear support bar being positioned opposite to each other about the seat;

the crossbar being mounted offset from the seat;

the front pulley being pivotably connected to the front support bar;

the rear pulley being pivotably connected to the rear support bar; and the resistance band being tensionably engaged to the front pulley, the crossbar, and the rear pulley.

17. The folding exercise chair for resistance training as claimed in claim 16 comprises:

each of the plurality of auxiliary resistance mechanisms further comprises a front stop, a front eyelet, a rear stop, and a rear eyelet;

the front stop being terminally connected to the resistance band;

the rear stop being terminally connected to the resistance band, opposite the front stop;

the front pulley and the rear pulley being tensionably engaged along the resistance band in between the front stop and the rear stop;

the front eyelet being fixed to the front stop; and the rear eyelet being fixed to the rear stop.

18. The folding exercise chair for resistance training as claimed in claim 16 comprises:

a second padded cross-brace;

the second padded cross-brace being oriented perpendicular to the height-adjustable backing;

the second padded cross-brace being positioned offset from the first padded cross brace along the height-adjustable backing; and the second padded cross-brace being positioned opposite to the seat along the height-adjustable backing.

19. The folding exercise chair for resistance training as claimed in claim 16 comprises:

the height-adjustable backing comprises a first telescoping tube, a second telescoping tube, and a connective handlebar;

the first telescoping tube being oriented parallel to the second telescoping tube;

the connective handlebar being terminally connected to the first telescopic tube;

the connective handlebar being terminally connected to the second telescopic tube;

the first telescopic tube being slidably and pivotably engaged to the collapsible chair frame, opposite to the connective handlebar; and the second telescopic tube being slidably and pivotably engaged to the collapsible chair frame, opposite to the connective handlebar.

* * * * *